US011898749B2

(12) United States Patent
Mastellari et al.

(10) Patent No.: US 11,898,749 B2
(45) Date of Patent: Feb. 13, 2024

(54) VALVE DELIVERY APPARATUS

(71) Applicant: SIT S.P.A., Padua (IT)

(72) Inventors: Luca Mastellari, Mestrino (IT); Lorenzo Zulian, Fosso (IT); Filiberto Rimondo, Saonara (IT)

(73) Assignee: SIT S.P.A., Padua (IT)

( * ) Notice: Subject to any disclaimer, the term of this patent is extended or adjusted under 35 U.S.C. 154(b) by 327 days.

(21) Appl. No.: 17/279,913

(22) PCT Filed: Aug. 23, 2019

(86) PCT No.: PCT/IT2019/050189
§ 371 (c)(1),
(2) Date: Mar. 25, 2021

(87) PCT Pub. No.: WO2020/065684
PCT Pub. Date: Apr. 2, 2020

(65) Prior Publication Data

US 2021/0396386 A1 Dec. 23, 2021

(30) Foreign Application Priority Data

Sep. 25, 2018 (IT) ..... 102018000008909

(51) Int. Cl.
*F23N 1/00* (2006.01)

(52) U.S. Cl.
CPC .... *F23N 1/005* (2013.01); *F23K 2900/05002* (2013.01); *F23N 2235/14* (2020.01); *F23N 2235/16* (2020.01); *F23N 2235/20* (2020.01); *F23N 2235/24* (2020.01)

(58) Field of Classification Search
CPC .. F23N 1/005; F23N 2235/14; F23N 2235/16; F23N 2235/20; F23N 2235/24; F23K 2900/05002
USPC ..... 431/14
See application file for complete search history.

(56) References Cited

U.S. PATENT DOCUMENTS

| | | | | |
|---|---|---|---|---|
| 7,523,762 | B2 * | 4/2009 | Buezis | G05D 16/163 137/489 |
| 2011/0226355 | A1 * | 9/2011 | Benvenuto | F23N 1/005 137/487.5 |
| 2019/0277496 | A1 * | 9/2019 | Hawkins | G05D 16/063 |

FOREIGN PATENT DOCUMENTS

| | | | |
|---|---|---|---|
| EP | 0 669 499 | A1 | 8/1995 |
| EP | 1 106 923 | A2 | 6/2001 |
| WO | 2004/088206 | A1 | 10/2004 |

OTHER PUBLICATIONS

International Search Report and Written Opinion from PCT/IT2019/05019 dated Jan. 7, 2020 (9 pages).

* cited by examiner

*Primary Examiner* — Avinash A Savani
(74) *Attorney, Agent, or Firm* — Calfee, Halter & Griswold LLP

(57) ABSTRACT

A gas delivery apparatus has a delivery pipe that extends from a gas entrance end to a gas delivery end along which an entrance component, a pressure regulator and a flow rate regulator are present, coordinated with each other in order to supply on each occasion the desired quantity of gas to a burner of an apparatus fed with gas. or p with an air-gas mixture.

20 Claims, 4 Drawing Sheets

VALVE DELIVERY APPARATUS

CROSS-REFERENCE TO RELATED APPLICATIONS

This application is a 371 of PCT Application No. PCT/IT2019/050189 filed on Aug. 23, 2019, which claims priority to Italian Application No. 102018000008909 filed on Sep. 25, 2018, the contents of which are hereby incorporated by reference as if recited in their entirety.

FIELD OF THE INVENTION

The present invention concerns a gas delivery apparatus to feed a burner present in a gas-fed apparatus, or fed with an air/gas mixture.

By way of non-restrictive example, the gas-fed apparatuses discussed here can include boilers, storage water heaters, stoves, ovens, fireplaces, or other similar or comparable apparatuses.

BACKGROUND OF THE INVENTION

It is known that gas-fed apparatuses have high efficiency and hygienic combustion only when the correct composition of the air/gas mixture is maintained in the range of available thermal flow rates.

Some known gas delivery apparatuses have a pressure regulator able to define the delivery pressure of the gas exiting from the delivery pipe toward the burner of the apparatus fed by gas, or by a defined air/gas mixture.

The pressure regulators, normally, have a shutter element associated with an aperture and configured to cooperate with a regulation membrane connected to a regulation spring to define the pressure of the gas downstream of the aperture.

The regulators provide that, by setting the contrast force of the regulation spring on the regulation membrane, and therefore on the shutter, it is possible to define the pressure of the gas downstream of the shutter.

These known solutions provide that the operation to regulate the pressure is performed by means of a mechanical calibration device, possibly commanded by a movement member that acts on the regulation spring defining its load.

However, making a regulation curve to obtain a hygienic combustion, by acting on the load of the regulation spring by means of a calibration device, requires an accuracy in the realization of the components involved in the regulation that makes their construction complex and expensive.

This problem is emphasized in the cases of applications that use an electronic combustion control.

In fact, in such applications a high modulation field is required (the modulation field is defined as the ratio between maximum flow delivered and minimum flow delivered), and a well-defined gradient of the modulation curve throughout the operating range.

Known pressure regulators do not allow to obtain a precise development of the characteristic of modulation of the flow rate of the exiting gas as a function of the command when operating at low flow rates, whether the command is intended as applied resistive force, or as displacement of the movement member.

It is also known that the delivery flow rate of the gas exiting from the pressure regulator is not linearly proportional to the contrast force exerted by the regulation spring on the regulation membrane.

It is also possible to use sensors to determine the combustion characteristics which, through indirect measurements, allow to verify and adapt the delivery of the exiting gas in order to allow hygienic combustion.

These sensors, however, do not allow to obtain a quick and precise regulation of the quantity of exiting gas, especially when it is necessary to deliver small quantities, since, in this latter case, the reaction times of the sensors are long and increasingly less acceptable.

In this context, the above aspects contribute to make the regulation of the quantity of gas delivered complicated and not dynamically adaptable to possible changes in the type of gas and/or the air/gas ratio desired on each occasion.

There is therefore a need to perfect and make available a gas delivery apparatus which overcomes at least one of the technical disadvantages mentioned above.

The purpose of the present invention is to provide a gas delivery apparatus which allows to deliver, on each occasion, the precise and desired quantity of gas according to requirements, the type of gas and the air/gas ratio required on each occasion, at the same time guaranteeing high performance and hygienic combustion in a wide range of thermal flow rates.

Another purpose of the present invention also is to provide a gas delivery apparatus able to obtain a modulation curve with an increasing gradient at low gas-flow rates.

Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, the present invention concerns an apparatus to deliver gas having a delivery pipe that extends from an entrance end to a gas delivery end, along which there are:

at least one electrovalve entrance component, configured to selectively open and close a first passage aperture of said delivery pipe respectively to allow or prevent the transit of the gas through it;

a pressure regulator provided with a shutter cooperating with a second aperture present in the delivery pipe and configured to regulate the pressure of the gas in the delivery pipe in order to obtain, downstream of the pressure regulator, a substantially constant gas pressure value independently of the pressure of the gas at entry.

According to some embodiments, the entrance component comprises at least one electrovalve, cooperating with the at least one first aperture in the delivery pipe in order to prevent or allow the passage of the gas through it. According to possible embodiments, the entrance component comprises two electrovalves, coaxial, or separated from each other.

The electrovalves can be held in a normally closed position by two respective holding springs, the electrovalves being able to be positioned on each occasion in an open position in relation to the action of at least an electrically powered coil associated with one or both of the electrovalves.

According to some embodiments, the pressure regulator is of the servo-regulated type.

According to some embodiments, the pressure regulator comprises a first regulation membrane, connected to the shutter and defining a first regulation chamber. This first regulation membrane is configured to move the shutter with respect to the second aperture in response to pressure variations in the first regulation chamber, so as to regulate the flow rate of the gas flow through the second aperture.

According to some embodiments, the shutter is connected on one side to the first regulation membrane and on the other to an elastic element configured to exert a force that acts on the shutter in the closing direction of the second aperture.

According to some embodiments, the first regulation chamber is fluidically connected to the delivery pipe by a passage channel present in the shutter.

The passage channel and the first regulation chamber therefore form a bypass channel for the gas toward the delivery end. When the pressure at entry increases and/or the pressure at exit exceeds a required value, the quantity of gas in the bypass channel and in the regulation chamber increases, thus increasing the load loss and returning the pressure at exit to the desired value. When the pressure at exit decreases below the required value, the first regulation membrane moves so as to move the shutter away from the second aperture, thus reducing the load loss and raising the pressure at exit to the required value.

According to possible embodiments, the pressure regulator comprises a second regulation membrane, defining a second compensation chamber which is fluidically connected with the first regulation chamber through a first passage channel, and with the delivery pipe through a second passage channel.

According to some embodiments, the second membrane separates the second compensation chamber from a third regulation chamber, which is in communication with the outside environment and is subjected to ambient pressure.

The second regulation membrane is configured to move toward/away from the first communication channel, so as to decrease or increase the size of the second compensation chamber, respectively in order to increase, or reduce, the pressure therein as a function of a pressure difference between the pressure in the second compensation chamber, the pressure of the gas at exit, and the atmospheric pressure.

According to a characteristic aspect of the present invention, the delivery apparatus also comprises a flow rate regulator, located downstream of the pressure regulator, and configured to regulate the flow rate of the gas exiting the delivery pipe.

According to some embodiments, the flow rate regulator comprises:

- a fixed body mounted in the delivery pipe and having a through aperture,
- a mobile body provided with a shutter portion mating with the through aperture, and
- a movement member configured to move the mobile body with respect to the fixed body, and position the shutter portion with respect to the through aperture in order to define on each occasion a determinate passage section of the gas as a function of their reciprocal position.

According to some embodiments, the movement member can move the shutter portion at least between an open position and a partly closed position, in which respectively the through aperture is open and the through aperture is partly closed by the shutter portion.

According to possible solutions, the shutter portion comprises an elastic flap, for example a blade, positionable in relation to the through aperture of the fixed body to determine the section of passage of the gas and therefore the delivery flow rate. The elastic flap is positioned by means of the movement member.

According to some embodiments, the movement member can comprise a stem with a first end located in contact, during use, with the elastic flap, and a second end connected to a linear actuator configured to position the stem and move it along its own longitudinal axis.

In accordance with possible embodiments, the first end of the stem comprises an ogive which, during use, is located in contact with the elastic flap. According to some embodiments, the ogive is eccentric with respect to the longitudinal axis of the stem.

According to some embodiments, the movement member that acts on the elastic flap can be configured to allow the rotation of the stem around its own longitudinal axis.

The rotation of the stem, preferably driven manually in the assembly step, serves to correctly position the stem with respect to the elastic flap, orientating the ogive in the correct position.

According to possible embodiments, the through aperture of the fixed body can have a first portion with a linear perimeter profile and a second portion with a tapered perimeter profile, wherein the first portion and the second portion are connected to each other by a connection portion with a substantially exponential perimeter profile.

According to possible embodiments, the movement member comprises a step motor, a linear and/or rotary actuator, or another type of similar or comparable movement member.

According to possible variant embodiments, the movement member can comprise a modulating element of the electromagnetic or pressure type, or another type.

According to possible solutions, the movement member is governed by a control and command unit in order to be driven so as to modulate the delivery flow rate of the gas exiting from the delivery end as a function of needs.

The control and command unit can, also, be configured to adapt the functioning of the movement member in relation to the type of gas used.

According to possible embodiments, the movement member has a shaft provided with a worm screw, and the mobile body has, along at least part of its external perimeter, a toothed sector engaging with the worm screw, said mobile body being configured to rotate around an axis of rotation orthogonal to the lying plane of the through aperture in relation to the action of the second movement member.

According to another variant embodiment, the fixed body and the mobile body can have a tubular shape, for example, a cylindrical shape.

In this case, the mobile body is coaxial to the fixed body and has a through aperture that can be positioned in relation to the through aperture of the fixed body to allow the delivery of the gas.

Depending on the reciprocal position of the two through apertures, a different passage section is defined on each occasion, which determines the flow rate of the gas delivered.

According to this variant, the through aperture of the mobile body can be positioned with respect to the through aperture of the fixed body by means of a linear actuator, or a rotary actuator.

According to a possible variant, downstream of the delivery end an air/gas mixing device is connected, provided with a fan able to deliver the desired quantity of air, in order to obtain on exit, on each occasion, a mixture having the desired air/gas ratio.

BRIEF DESCRIPTION OF THE DRAWINGS

These and other characteristics of the present invention will become apparent from the following description of some embodiments, given as a non-restrictive example, with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
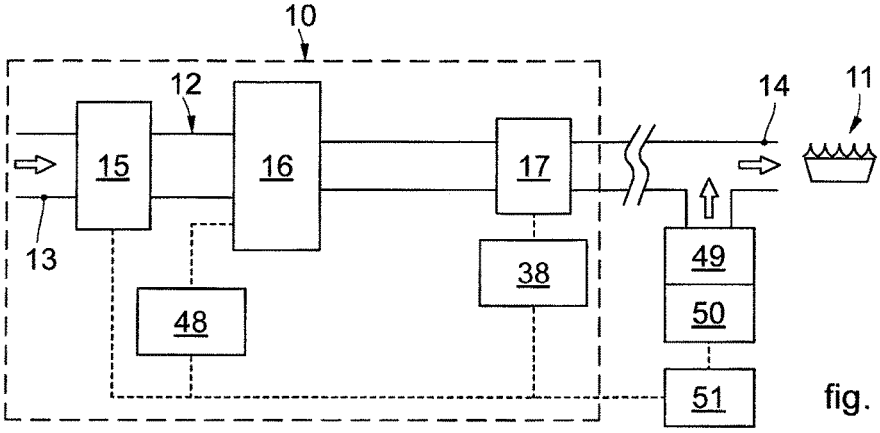
FIG. 1 schematically shows an apparatus to deliver gas according to a possible embodiment of the present invention.

Embodiments described here, with reference to the drawings, concern a gas delivery apparatus 10 to feed a burner 11 present in a gas-fed apparatus, or fed with an air/gas mixture.

Gas-fed apparatuses discussed here comprise boilers, storage water heaters, stoves, ovens, fireplaces, or other similar or comparable apparatuses in which there is at least one burner 11, fed with natural gas, methane, propane, or other gases, or air/gas mixtures.

The gas delivery apparatus 10 has a delivery pipe 12 which extends from an entrance end 13 to a delivery end 14 of the gas.

The delivery pipe 12, during use, is connected on one side to a gas-feed source, and on the other to a gas burner.

According to some embodiments, along the delivery pipe 12 there are an entrance component 15, a pressure regulator 16 and a flow rate regulator 17.

According to possible embodiments, the entrance component 15 is configured to selectively open and close at least one first passage aperture 19 present in the delivery pipe 12 respectively to allow or prevent the transit of the gas through it.

According to some embodiments, the entrance component 15 comprises at least one electrovalve 18*a*.

According to possible solutions, the entrance component 15 has two electrovalves 18*a* and 18*b* cooperating with the at least one first aperture 19, which are held in a normally closed position by two respective holding springs 20*a* and 20*b*.

According to possible embodiments, the two electrovalves 18*a* and 18*b* can be coaxial to each other or separated from each other.

Figure 3:
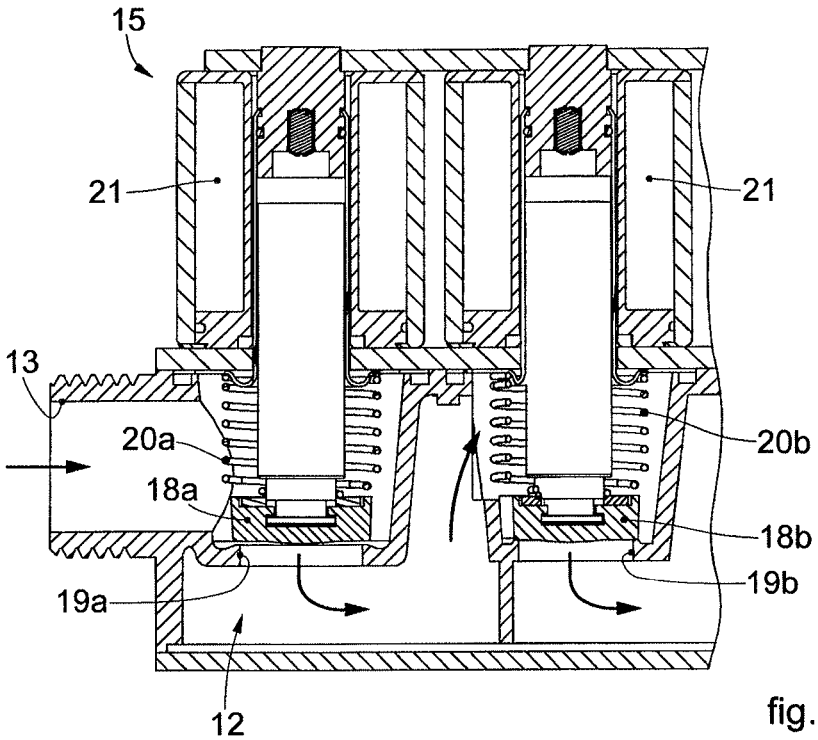
FIG. 3 is a section of a portion of an apparatus to deliver gas according to a possible embodiment.

With reference to FIG. 3, the two electrovalves 18*a* and 18*b* can be located in succession to each other along the delivery pipe 12. In this case, given by way of example, the electrovalves 18*a* and 18*b* are respectively associated with a respective aperture 19*a*, 19*b*.

The electrovalves 18*a* and 18*b* are configured to be positioned on each occasion in an opening position of the respective aperture 19*a*, 19*b* with which they are associated in relation to the action of at least one electrically fed coil 21.

According to some embodiments, the entrance component 15 can comprise a single electrically fed coil 21, which can be functionally associated with both electrovalves 18*a* and 18*b*.

According to possible variants, the entrance component 15 can comprise two electrically fed coils 21, each associated with a corresponding electrovalve 18*a* and 18*b*.

According to possible embodiments, when the coil 21 is fed, it contrasts the holding force exerted by the two holding springs 20*a* and 20*a* and positions both the electrovalves 18*a* and 18*b* in order to open the apertures 19*a*, 19*b*, so as to allow the gas to transit through them.

In the case of two distinct and separate electrovalves 18*a* and 18*b*, each coil 21 contrasts, during use, the holding force exerted by the respective holding spring 20*a* and 20*a* associated with the corresponding electrovalve 18*a* and 18*b*.

According to some embodiments, the electrovalves 18*a* and 18*b* can be positioned in a common direction perpendicular to the lying plane of the first aperture 19.

The entrance component 15 performs a safety function, since, if a malfunction occurs or it is necessary to intervene on the gas delivery apparatus 10, or on the gas-fed apparatus connected thereto, it can be driven in order to stop the gas delivery promptly.

The entrance component 15 can be configured to be replaceable without altering, or replacing, the first aperture 19 of the delivery pipe 12.

This allows to use entrance components 15 having different characteristics without modifying the geometry of the delivery pipe 12 and in particular of the first aperture 19.

The pressure regulator 16 is configured to regulate the gas pressure in the delivery pipe 12 so as to supply, downstream of the pressure regulator 16 itself, a gas pressure substantially constant around a desired value, independently of a pressure Pin of the gas at entry.

According to some embodiments, the pressure regulator 16 is of the servo-assisted or servo-regulated type.

According to possible embodiments, the pressure regulator 16 is provided with a shutter 22 cooperating with a second aperture 23 present in the delivery pipe 12.

According to some embodiments, the pressure regulator 16 comprises a first regulation membrane 24 connected to the shutter 22 and able to define a first regulation chamber 25 separated from the delivery pipe 12 but communicating with it.

According to some embodiments, the first regulation chamber 25 communicates with the delivery pipe 12 through a passage channel 32.

According to some embodiments, the shutter 22 is hollow and is provided inside it with the passage channel 32 for the gas According to some embodiments, the passage channel 32 is provided with at least one narrowing 32*a* having a smaller passage section.

The first regulation membrane 24 is configured to move the shutter 22 with respect to the second aperture 23 in response to the pressure variations that occur in the first regulation chamber 25 and in relation to the exit pressure Pout.

The first regulation membrane 24, in particular, is configured to exert a force that acts on the shutter 22 in order to move it away from the second aperture 23 and allow the gas in the delivery pipe 12 to pass through it when the exit pressure Pout is lower than a required value, and to exert a force in the opposite direction, bringing the shutter 22 close to the second aperture 23 when the exit pressure Pout is higher than the required value.

According to some embodiments, the pressure regulator 16 comprises a regulation spring 26 connected to the first regulation membrane 24 and configured to exert an elastic force on the first regulation membrane 24, and therefore on the shutter 22 associated therewith, so as to move it in the closing direction of the second aperture 23.

The spring 26 and the pressure in the first regulation chamber 25 therefore contribute to modify the position of the shutter 22 with respect to the second aperture 23 and therefore to define the pressure of the gas downstream of the shutter 22 itself.

Figure 2A:
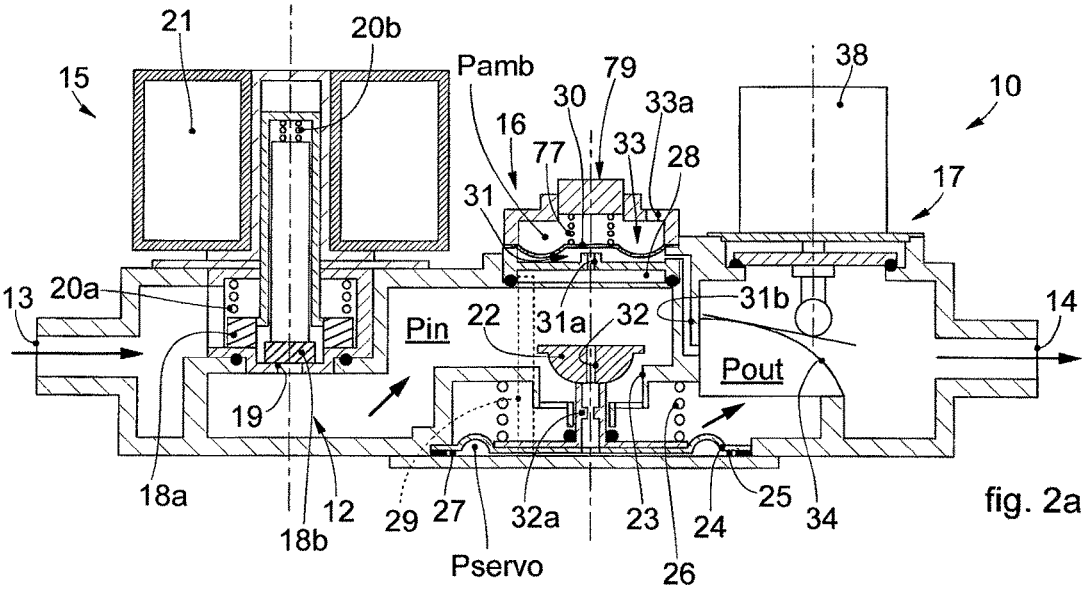
FIG. 2*a* is a schematic view of an apparatus to deliver gas according to a possible embodiment.

According to some embodiments, for example described with reference to FIG. 2*a*, the regulation chamber 25 can be divided into a first sub-chamber 27, and a second sub-chamber 28 connected to each other by a communication channel 29.

According to some embodiments, the first sub-chamber 27 can be provided below the shutter 22, so as to exert a force from the bottom upward on it in order to move it away from the second aperture 23, and the second sub-chamber 28 can be provided above it, in correspondence with an upper part of the delivery pipe 12.

Figure 2B:
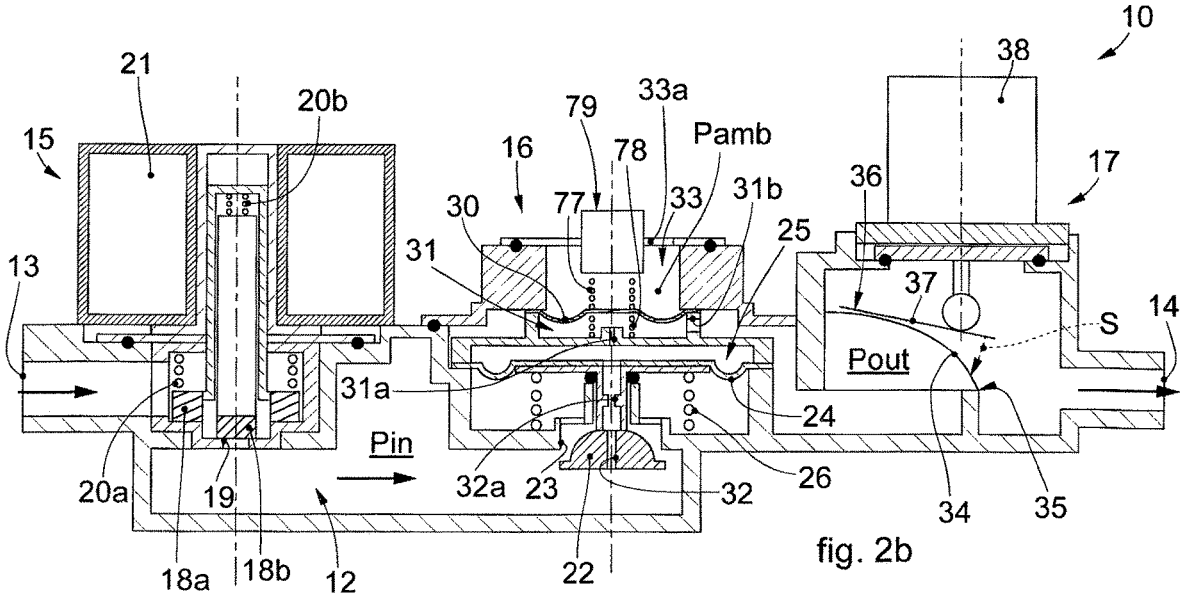
FIG. 2*b* is a schematic view of an apparatus to deliver gas according to a variant embodiment.

According to other embodiments, for example described with reference to FIG. 2*b*, the first regulation chamber 25 can be in a single piece. The first regulation chamber 25 can be provided above the shutter body 22, so as to exert on it a force from above downward in order to move it away from the second aperture 23.

According to possible embodiments, the pressure regulator 16 comprises a second regulation membrane 30 that defines a second compensation chamber 31 fluidically connected to the first regulation chamber 25 through a first passage channel 31*a*, and to the delivery pipe 12 downstream of the second aperture 23 through a second passage channel 31*b*.

According to some embodiments, the second regulation membrane 30 separates the second compensation chamber 31 from a third regulation chamber 33 which is put in communication with the outside environment, for example through an aperture 33*a*, and is therefore subjected to the ambient pressure Pamb.

The second regulation membrane 30 is then subjected on one side to the ambient pressure Pamb, and on the other to a servo-regulated pressure Pservo and to the exit pressure Pout, and is configured to move toward/away from the first passage channel 31*a*. The movement of the second regulation membrane 30 determines an increase or a reduction of the gas passage section through the first passage channel 31*a*, respectively in order to reduce, or increase, the pressure therein, as a function of a pressure difference between the pressure Pservo in the second compensation chamber 31 and/or the pressure of the gas at exit Pout, and the atmospheric pressure Pamb.

The movement of the second regulation membrane 30 determines as a consequence also an increase or decrease in the size of the second compensation chamber 31.

This configuration allows to keep the pressure of the gas downstream of the second aperture 23 and the pressure of the gas in the second compensation chamber 31 constant, due to the force defined by the compression of the spring 26, and by the pressure in the first regulation chamber 25, independently of the entrance pressure Pin.

According to some embodiments, an elastic element can be provided, for example a second spring 77, configured to exert an elastic force on the second regulation membrane 30 in the closing direction of the first passage channel 31*a*.

According to some embodiments, another elastic element can also be present, for example a third spring 78 connected to the second regulation membrane 30 on the opposite side with respect to the second spring 77 and configured to exert an elastic force on the regulation membrane 30 in the opposite direction to the second spring 77.

According to some embodiments, a mechanical calibration device 79 can also be provided, possibly commanded by a movement member configured to act, for example, on the second spring 77 in order to regulate its load, for example during an initial calibration step of the delivery apparatus 10, after possible maintenance, or if the type of gas used is changed.

According to variants of embodiments, the mechanical calibration device 79 can comprise a manually driven worm screw.

According to one aspect of the present invention, the gas delivery apparatus 10 also has a flow rate regulator 17 located downstream of the pressure regulator 16.

The flow rate regulator 17 comprises a fixed body 34, mounted in the delivery pipe 12 and having a through aperture 35, and a mobile body 36 provided with a shutter portion 37 mating with the through aperture 35.

The shutter portion and the through aperture 35 are mobile with respect to each other to define on each occasion a determinate passage section S of the gas through the through aperture 35 in relation to their reciprocal position.

According to some embodiments, the flow rate regulator 17 comprises a movement member 38 configured to position the shutter portion 37 with respect to the through aperture The movement member 38 can be configured to move the shutter portion 37 at least between an open position, in which the through aperture 35 is open and the passage section S for the gas has a maximum size, and a partially closed position, in which the through aperture 35 is partially closed by the shutter portion 37, and the passage section S has a smaller size than the maximum size.

According to some embodiments, the movement member 38 is configured to position the shutter portion 37 in a plurality of different positions with respect to the through aperture 35 in order to define on each occasion a desired size of the passage section S.

Figure 4:
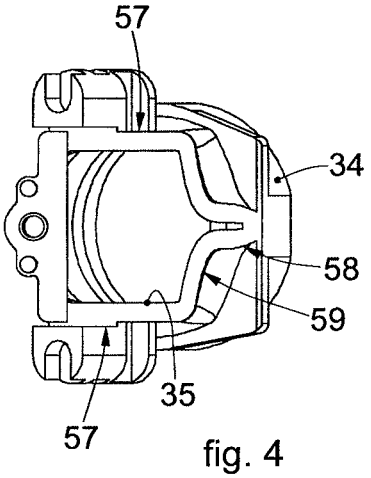
FIG. 4 is a view from above of a fixed body of a flow rate regulator of an apparatus to deliver gas.

According to possible embodiments, for example described with reference to FIGS. 4 and 5, the shutter portion 37 of the mobile body 36 can comprise an elastic flap 52 which can be positioned, on each occasion, in relation to the through aperture 35 of the fixed body 34 by means of the movement member 38.

One end of the elastic flap 52 can be attached to the fixed body 34 by suitable attachment means 53, such as for example screws, or other.

According to possible embodiments, the movement member 38 comprises a stem 54 having a first end 55 located in contact with the elastic flap 52 and a second end connected to a linear actuator 56.

The linear actuator 56 is configured to position the stem 54 along its longitudinal axis Z. This allows to position the elastic flap 52 in relation to the through aperture 35, so as to define the flow rate of gas delivered.

For example, the linear actuator 56 can comprise a servomotor, a step motor, a mechanism to convert motion into a linear motion, or another similar or comparable member.

The section of passage of the gas through the through aperture 35 is determined, on each occasion, by the position of the elastic flap 52 with respect to the through aperture 35, which in turn is defined by the position of the stem 54 along its longitudinal axis Z.

This embodiment not only simplifies the geometry of the flow rate regulator 17, as it comprises a limited number of components, but also allows to modulate in a controlled manner the functional relation which connects the gas flow rate Q to the position of the shutter portion 37 determined on each occasion by the movement member 38.

The Applicant has found that it is possible to obtain a well-defined modulation curve of the gas flow rate Q as a function of the position of the shutter portion 37, or the elastic flap 54, defined by the movement member 38 with an increasing gradient at low gas flow rates.

An angle $\alpha$ is defined between the longitudinal axis Z of the stem 54 and the plane tangent to the elastic flap 52 in the point where the latter is attached to the fixed body 34.

The Applicant has found that as the angle $\alpha$ increases, the development of the modulation curve of the gas flow rate Q changes as a function of the command d, whether it is understood as an extension of the stem 54 along the longitudinal axis Z, or as a number of steps of the actuator 56 which drives the stem 54. See, for example, the schematic development shown in FIG. 6.

Figure 6:
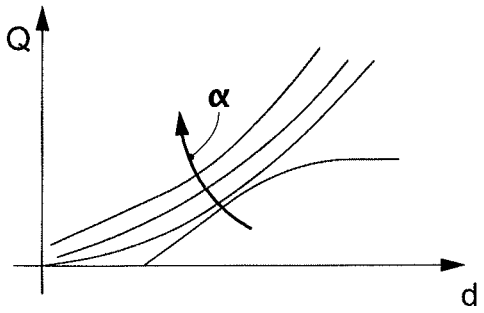
FIG. 6 schematically shows the development of the characteristic flow rate vs command and how it can be modulated at low flow rates.
Figure 7:
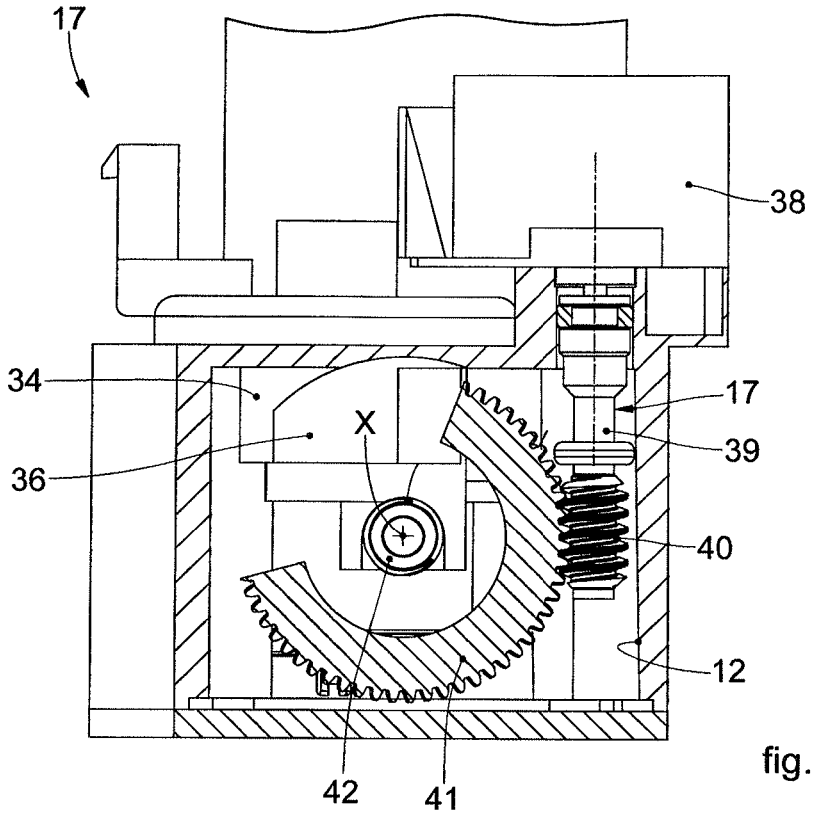
FIG. 7 is a section view of a flow rate regulator according to variant embodiments described here.

In FIG. 6, the arrow shows schematically how the modulation curve varies according to the angle $\alpha$.

Figure 5:
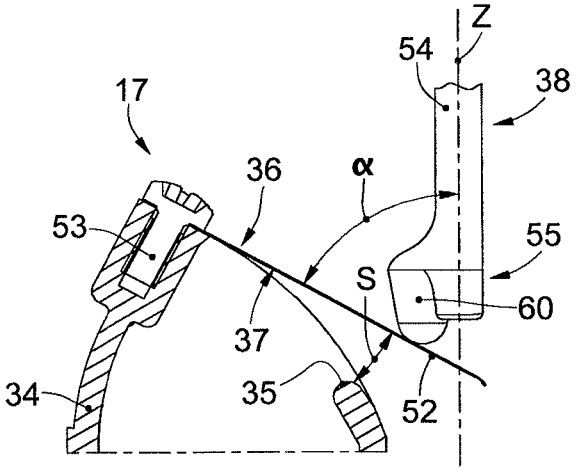
FIG. 5 is a section of a detail of a flow rate regulator according to possible embodiments.

According to possible embodiments, shown in FIG. 5, the profile of the through aperture 35 can be an arc of a circle.

Different profiles of the through aperture 35 can also be provided.

Applicant has found that by decreasing the radius of curvature of the profile of the through aperture 35, the gradient of the modulation curve of the flow rate Q increases as a function of the command d.

According to possible embodiments, the through aperture 35 of the fixed body 34 has at least a first portion 57 having a linear perimeter profile and at least a second portion 58 having a tapered perimeter profile.

The first portion 57 and the second portion 58 are connected to each other by a connection portion 59.

According to possible advantageous embodiments, the connection portion 59 has a preferably exponential perimeter profile.

Applicant has found that by passing from a connection portion 59 with a linear perimeter profile to a connection portion 59 with an exponential perimeter profile the gradient of the modulation curve of the flow rate Q increases as a function of the command d.

According to possible embodiments, the first end 55 of the stem 54 in contact with the elastic flap 52 comprises a ogive 60 located in contact with the elastic flap 52.

The ogive 60 is advantageously eccentric with respect to the longitudinal axis Z of the stem 54.

According to possible advantageous embodiments, the point of contact of the ogive 60 with the elastic flap 52 is eccentric with respect to the longitudinal axis Z of the stem 54.

According to some embodiments, the movement member 38 comprises an electric motor 61, for example of the step type, provided with a drive shaft connected to, or defining the stem 54, configured to move the latter axially in predefined positions.

According to possible embodiments, for example described with reference to FIGS. 10 and 11, the delivery pipe 12 can be at least partly closed upward by an upper covering element 62, and the movement member 38, in the example case the electric motor 61, can be installed above it, with its own drive shaft, that is, the stem 54, passing through a suitable passage hole 63 made in it.

According to some embodiments, the upper covering element 62 can be shaped in such a way as to define a housing seating 64 suitable to house at least a lower portion **65*a* of a containing casing 65 of the movement member 38, so as to guarantee a stable and precise positioning thereof. According to possible variants, the lower portion 65*a* can extend inside the passage hole 63 through the upper covering element 62**.

According to some embodiments, the electric motor 61 can be the gas-tight type, that is, configured to prevent gas leaks through it toward the surrounding environment, or at least keep them below the limits imposed by regulations.

According to some embodiments, for example described with reference to FIGS. 11-12, the electric motor 61 can be the non-gas-tight type, so as to reduce the overall costs of the flow rate regulator 17, and therefore of the apparatus 10.

According to these variants, the flow rate regulator 17 can comprise a sealing device 66 configured to guarantee the seal of the movement member 38, preventing the gas, or the air-gas mixture, from escaping from the delivery pipe 12 toward the external environment.

According to some embodiments, for example described with reference to FIG. 9, the sealing device 66 comprises a ring gasket 67 configured to cooperate with the stem 54, guaranteeing a radial seal of the latter.

The ring gasket 67 can comprise a sealing lip 68, also called a "lip-ring", of the single or double type, which extends toward the central portion of the ring gasket 67, so as to define a sliding seal on the stem 54.

According to other embodiments, the ring gasket 67 can be disposed inside the housing seating 64, and has a shape substantially mating with it. In this way, the lower portion **65*a* of the containing casing 65 of the motor 61 is positioned in the housing seating 64 above the ring gasket 67, thus preventing unwanted axial movements of the latter which could otherwise occur due to the sliding of the stem 54. According to possible variant embodiments, for example described with reference to FIG. 10, the sealing device 66 comprises a bellows seal 69 made of flexible material, attached to the stem 54** and configured to extend and contract as a function of the axial movement of the latter.

The bellows seal 69 is configured to completely surround the stem 54 in a radial direction.

Figure 10:
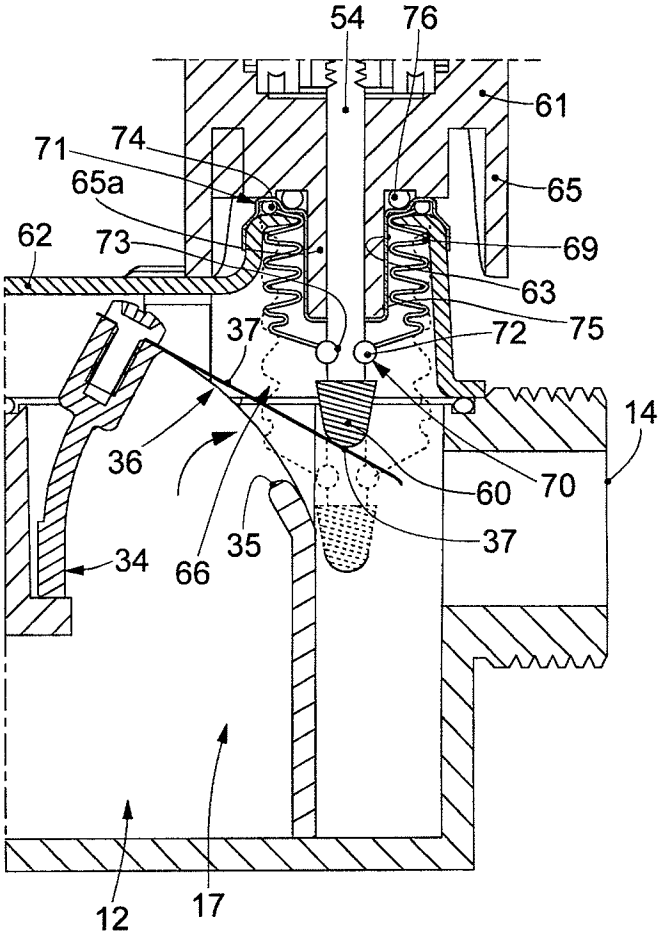
FIG. 10 is a section view of a detail of a flow rate regulator according to other embodiments described here.

In FIG. 10, by way of example, two possible positions of the stem 54 and of the bellows seal 69 are shown, of which a contracted position is shown in a continuous line and an extended position is shown in a dotted line.

The bellows seal 69, in the contracted position, can have a plurality of folds, folded over on themselves and collected in a pack, which tend to extend in the extended position.

According to some embodiments, the bellows seal 69 is constrained with a lower end 70 to the stem 54, in proximity to the first end 55 of the latter, and with an upper end 71 to the upper covering element 62.

According to some embodiments, the lower end 70 comprises a lower sealing ring 72 protruding toward the inside and configured to act as a radial sealing element. The stem 54 can be provided with a mating seating 73 suitable to house and hold the lower sealing ring 72.

According to some embodiments, the upper end 71 comprises an upper sealing ring 74 configured to function as an axial sealing element, which, during use, is compressed between the upper covering element 62 and the containing casing 65.

According to variant embodiments, a thin guide sleeve 75 can also be provided, shaped in such a way as to surround the lower portion 65*a* of the containing casing 65 which extends below the passage hole 23, leaving a passage gap for the stem 54, and to follow the profile of the upper covering element 62 at the upper part.

Another sealing ring 76 can also be provided between the guide sleeve 75 and the containing structure of the motor 61.

If the membrane ruptures, the interference gap between the stem 54 and the guide 75 guarantees a controlled leak, in order to comply with safety regulations.

Figure 8:
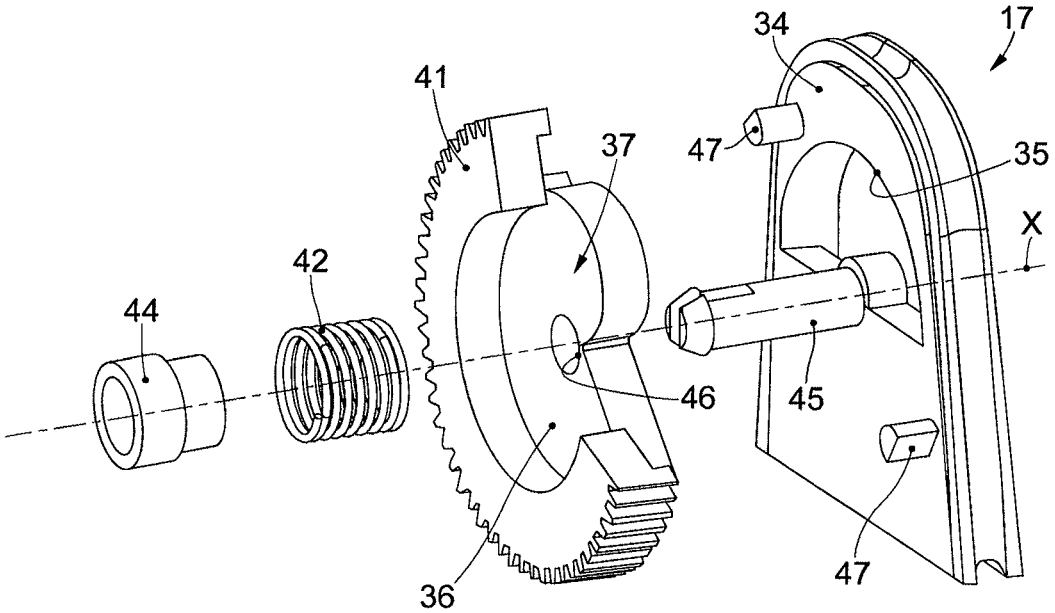
FIG. 8 is an exploded view of a flow rate regulator of an apparatus to deliver gas according to a possible embodiment of the present invention.
Figure 9:
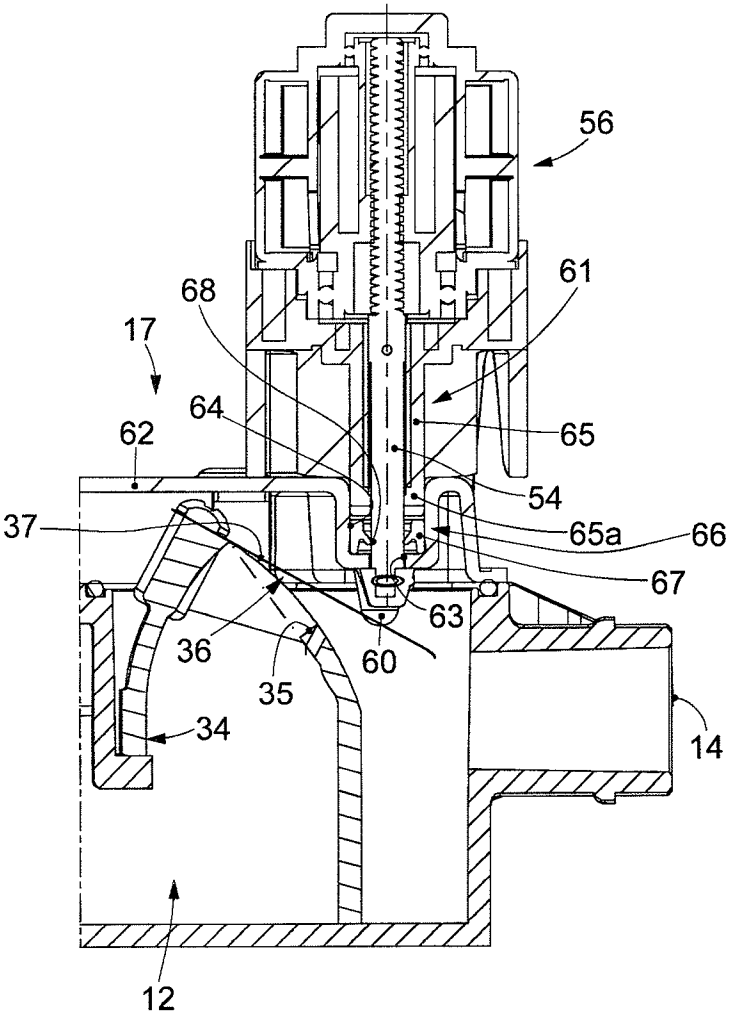
FIG. 9 is a section view of a flow rate regulator according to variant embodiments described here.

According to possible variant embodiments, described for example with reference to FIGS. 8 and 9, the second movement member 38 can be configured to allow the stem 54 to rotate around its longitudinal axis Z.

The rotation of the stem 54, preferably driven manually during the assembly step, serves to correctly position the stem 54 with respect to the elastic flap 52.

By rotating the stem 54 around its longitudinal axis Z, if the ogive 60 is present, it is possible to regulate the position of the point of contact of the ogive 60 with the elastic flap 52.

According to possible embodiments, the movement member 38 can comprise a manually driven screw.

According to possible embodiments, the movement member 38 has a shaft 39 provided with a worm screw 40, and the mobile body 36 has, along at least part of its external perimeter, a toothed sector 41 engaging with the worm screw 40.

In accordance with possible embodiments, the mobile body 36 is configured to rotate around an axis of rotation X orthogonal to the lying plane of the through aperture 35 in relation to the action of the movement member 38.

According to a possible embodiment, the axis of rotation X is substantially perpendicular to the axis of movement of the two electrovalves 18*a* and 18*b* and/or of the shutter 22.

This configuration of the gas delivery apparatus 10 is particularly advantageous since it has a limited bulk, it simplifies the assembly and/or maintenance operations, it also allows to contain the extension of the delivery pipe 12 and it determines lower load losses because the flow is not diverted.

Depending on the number of revolutions, the feed steps, or also the electric command signal of the movement member 38, it is possible to define the reciprocal position of the shutter portion 37 and the through aperture 35.

This reciprocal position allows to define the flow rate according to the type of gas. By adapting the reciprocal position on each occasion according to the type of gas, it is possible to supply the desired quantity of gas precisely.

According to possible embodiments, the flow rate regulator 17 comprises an elastic thrust body 42 located in contact with the mobile body 36 and with an abutment portion 43 of the delivery pipe 12, or with an abutment body 44 located in contact with the abutment portion 43.

The elastic thrust body 42 is configured to exert a thrust on the mobile body 36 toward the fixed body 34 such as to reduce the through aperture 35 to a minimum when the shutter portion 37 is in a partly closed condition.

According to possible embodiments, the flow rate regulator 17 comprises a cylindrical body 45 attached to, or forming part of, the fixed body 34 inserted in a through hole 46 present in the mobile body 36 and able to define the axis of rotation X of the mobile body 36 itself.

According to a variant, the elastic thrust body 42 is inserted into the cylindrical body 45 and cooperates with it to define the thrust direction along which the elastic thrust body 42 acts.

According to possible embodiments, the fixed body 34 can have one or more protruding reference portions 47 mating with the mobile body 36, which are positioned in such a way as to define mechanical references for the positioning of the shutter portion 37.

In other words, the mobile body 36 is conformed so as not to be able to rotate further in one direction of rotation or the other when it is associated in abutment with one or the other of the protruding reference portions 47.

According to another variant embodiment, not shown, the fixed body 34 and the mobile body 36 can have a tubular shape, for example, a cylindrical shape.

In this case, the mobile body 36 is coaxial with the fixed body 34 and has a through aperture which can be positioned in relation to the through aperture 35 of the fixed body 34 to allow the delivery of the gas.

Depending on the reciprocal position of the two through apertures, the passage section, and therefore the flow rate of the delivered gas, is defined on each occasion.

According to this variant, the through aperture of the mobile body 36 can be positioned with respect to the through aperture 35 of the fixed body 34 by means of the movement member 38 which, in this case, can comprise a linear actuator or a rotary actuator.

According to possible variants, an air/gas mixing device 49 can be disposed downstream of the delivery end 14, and is provided with a fan 50 able to deliver the desired quantity of air to obtain in output, on each occasion, a mixture with the desired air/gas ratio.

In accordance with possible solutions, the movement member 38 is governed by a control and command unit 51 to be driven in a coordinated manner in order to modulate the delivery flow rate of the gas exiting the delivery end 14.

The control and command unit 51 can be associated with the gas-fed apparatus, for example the control and command unit 51 can be the control board of a boiler intended to perform a plurality of functions.

According to possible variants, the control and command unit 51 can be an electronic board outside the control board of the boiler.

The delivery flow rate and the pressure of the gas exiting the delivery end 14 can be defined in relation to one or more quantities selected from a group comprising the type of gas used, the position of the shutter portion 37, the pressure of the gas downstream of the second aperture 23 which, in turn, is a function of the position of the shutter 22 of the pressure regulator 16, correlated to the sum of the forces acting thereon, determined by the pressure of the gas and by the elastic force of the elastic elements 26, 77, 78.

According to some embodiments, calibration devices can be provided configured to calibrate the elastic force exerted by the elastic elements 77, 78, which can be possibly commanded by the control and command unit 51.

According to possible embodiments, the control unit 51 defines the delivery flow rate and the quantity of air delivered by the fan 50 to obtain the desired air/gas ratio.

One of the advantages of the present invention is that, thanks to the pressure regulator 16, combined with the flow rate regulator 17, it is possible to define on each occasion the correct functional characteristic of the gas flow rate and the command signal provided to the movement member 38.

In fact, based on the type of gas it is possible to define a specific elastic force of one or more elastic elements 77, 78 of the pressure regulator 16, which in turn defines a specific calibration curve of the functional relation for the flow rate of the gas exiting the pressure regulator 16 itself.

Furthermore, depending on the conformation of the through aperture 35 and/or the mating shutter portion 37, it is possible to define a specific curve of the gas flow rate Q as a function of the command d.

In other words, the gas delivery apparatus 10 allows to parameterize the functional relationship between the gas flow rate and the command signal provided to the movement member 38 by selecting the suitable pressure of the gas downstream of the second aperture 23.

In order to obtain the same result without the flow rate regulator 17 it would in fact be necessary to replace the pressure regulator 16 and/or calibrate or modify the membranes 24, 30 or the elastic elements 26, 77, 78 on each occasion.

It is clear that modifications and/or additions of parts may be made to the gas delivery apparatus 10 as described heretofore, without departing from the field and scope of the present invention.

It is also clear that, although the present invention has been described with reference to some specific examples, a person of skill in the art shall certainly be able to achieve many other equivalent forms of gas delivery apparatus 10, having the characteristics as set forth in the claims and hence all coming within the field of protection defined thereby. In the following claims, the sole purpose of the references in brackets is to facilitate reading; they must not be considered as restrictive factors with regard to the field of protection claimed in the specific claims.

The invention claimed is:

1. Gas delivery apparatus, to feed at least one burner in an apparatus fed with gas or with an air-gas mixture, wherein said gas delivery apparatus has a delivery pipe that extends from a gas entrance end to a gas delivery end, there being present, along said delivery pipe:

an entrance component having at least one electrovalve, and cooperating with at least one first aperture present in said delivery pipe, said at least one electrovalve being positioned on each occasion with respect to said first aperture in relation to the action of at least one electrically-fed coil;

a pressure regulator of the servo-regulated type, provided with a shutter cooperating with a second aperture present in said delivery pipe and configured to regulate the gas pressure in the delivery pipe in order to obtain, downstream of the pressure regulator, a substantially constant gas pressure value irrespective of the pressure of the entering gas;

a flow rate regulator configured to regulate the flow rate of the gas in correspondence with said delivery end, comprising a fixed body fixed in said delivery pipe and having a through aperture, a mobile body provided with a shutter portion mating with said through aperture, and a movement member configured to position said shutter portion with respect to said through aperture in order to define on each occasion a determinate section for the passage of the gas as a function of their reciprocal position; and wherein said passage section of the gas defines the gas flow rate in correspondence with said delivery end, and wherein said gas flow rate regulator allows for modulating the gas flow rate according to a predefined modulation curve of the gas flow rate as a function of the position of the shutter portion.

2. Apparatus as in claim 1, wherein said pressure regulator comprises a first regulation membrane, connected to the shutter, and defining a first regulation chamber fluidically connected to said delivery pipe through a passage channel and an elastic element configured to exert a force on said shutter in the direction of closing of said second aperture, wherein said first regulation membrane is configured to move said shutter with respect to said second aperture in response to the variations in pressure of the exiting gas.

3. Apparatus as in claim 2, wherein said pressure regulator comprises a second regulation membrane, defining on one side a second compensation chamber which is fluidically connected to the first regulation chamber through a first passage channel and with the delivery pipe through a second passage channel, and on the other side a third regulation chamber which is subjected to ambient pressure, wherein said second regulation membrane is configured to move at least as a function of a pressure difference between the pressure in said second compensation chamber and/or the exiting gas, and the ambient pressure.

4. Apparatus as in claim 1, wherein said shutter portion comprises an elastic flap which can be positioned on each occasion in relation to said through aperture by said movement member, wherein said movement member comprises a stem having a first end located in contact with said elastic flap and a second end connected to a linear actuator configured to position said stem along its longitudinal axis.

5. Apparatus as in claim 4, wherein said first end of said stem comprises an ogive located in contact with said elastic flap, wherein said ogive is eccentric with respect to said longitudinal axis.

6. Apparatus as in claim 1, wherein said through aperture of said fixed body has at least a first portion having a linear perimeter profile and at least a second portion having a tapered perimeter profile, wherein said first portion and said second portion are connected to each other by means of a connection portion having an exponential perimeter profile.

7. Apparatus as in claim 1, wherein said movement member has a shaft provided with a worm screw, and said mobile body, along at least part of its external perimeter, has a toothed sector engaged with said worm screw, said mobile body being configured to rotate around an axis of rotation orthogonal to the lying plane of said through aperture in relation to the action of said movement member.

8. Apparatus as in claim 1, wherein said movement member comprises a movement member selected from a group consisting of a servomotor, a stepper motor, a linear and/or rotary actuator, and a manually driven screw.

9. Apparatus as in any claim 1, wherein a flow rate regulator comprises a sealing device configured to guarantee the seal of said movement member, preventing the gas, or the mixture of air-gas, from escaping from said delivery pipe toward the external environment.

10. Apparatus as in claim 4, wherein a sealing device comprises a ring gasket configured to cooperate with said stem, guaranteeing a radial seal of the latter.

11. Apparatus as in claim 4, wherein said sealing device comprises a bellows seal made of flexible material, constrained with a lower end to said stem and with an upper end to an upper covering element and configured to extend and contract as a function of the axial movement of said stem.

12. Apparatus as in any claim 1, wherein said entrance component comprises two electrovalves coaxial with each other and respectively associated with a respective aperture.

13. Apparatus as in claim 3, wherein said shutter portion comprises an elastic flap which can be positioned on each occasion in relation to said through aperture by said movement member, wherein said movement member comprises a stem having a first end located in contact with said elastic flap and a second end connected to a linear actuator configured to position said stem along its longitudinal axis.

14. Apparatus as in claim 13, wherein said first end of said stem comprises an ogive located in contact with said elastic flap, wherein said ogive is eccentric with respect to said longitudinal axis.

15. Apparatus as in claim 14, wherein said through aperture of said fixed body has at least a first portion having a linear perimeter profile and at least a second portion having a tapered perimeter profile, wherein said first portion and said second portion are connected to each other by means of a connection portion having an exponential perimeter profile.

16. Apparatus as in claim 3, wherein said movement member has a shaft provided with a worm screw, and said mobile body, along at least part of its external perimeter, has a toothed sector engaged with said worm screw, said mobile body being configured to rotate around an axis of rotation orthogonal to the lying plane of said through aperture in relation to the action of said movement member.

17. Apparatus as in claim 16, wherein said movement member comprises a movement member selected from a group consisting of a servomotor, a stepper motor, a linear and/or rotary actuator, and a manually driven screw.

18. Apparatus as in claim 17, wherein said flow rate regulator comprises a sealing device configured to guarantee the seal of said movement member, preventing the gas, or the mixture of air-gas, from escaping from said delivery pipe toward the external environment.

19. Apparatus as in claim 9, wherein said sealing device comprises a ring gasket configured to cooperate with said stem, guaranteeing a radial seal of the latter.

20. Apparatus as in claim 9, wherein said sealing device comprises a bellows seal made of flexible material, constrained with a lower end to said stem and with an upper end to an upper covering element and configured to extend and contract as a function of the axial movement of said stern.

* * * * *